US005193336A

United States Patent [19]

King

[11] Patent Number: 5,193,336

[45] Date of Patent: Mar. 16, 1993

[54] TOOL AND METHOD FOR REMOVING A CLIP MEMBER FROM A MASTER LINK IN A CHAIN MEMBER

[76] Inventor: John W. King, Rte. 1, Mayfield, Kans. 67103

[21] Appl. No.: 762,480

[22] Filed: Sep. 19, 1991

[51] Int. Cl.[5] ..... B21L 9/06

[52] U.S. Cl. ..... 59/7; 59/11; 81/426.5

[58] Field of Search ..... 59/7; 81/300, 418, 421, 81/424.5, 426, 426.5, 15.8

[56] References Cited

U.S. PATENT DOCUMENTS

| | | | |
|---|---|---|---|
| 243,480 | 6/1881 | Whiting | 81/426.5 |
| 3,379,005 | 4/1968 | Jones | 59/7 |
| 3,647,186 | 3/1972 | Hartman | 81/426.5 |
| 3,854,282 | 12/1974 | Mazel | 59/7 |
| 3,937,005 | 2/1976 | Becker | 59/7 |
| 4,289,015 | 9/1981 | Porter | 59/7 |

FOREIGN PATENT DOCUMENTS

| | | | |
|---|---|---|---|
| 481550 | 3/1952 | Canada | 59/7 |
| 1111759 | 3/1956 | France | 59/7 |

*Primary Examiner*—David Jones
*Attorney, Agent, or Firm*—John Wade Carpenter

[57] ABSTRACT

A tool for removing a clip member from a master link in a chain member. The tool comprises a first member pivotally secured to a second member with the first member including a first plier jaw having a structure defining a pair of first arcuate recesses and with the second member including a second plier jaw having a structure defining a pair of second arcuate recesses. A method for removing a clip member from a master link in a chain member comprising providing the tool; providing a chain member comprising a master link with a clip member; and grasping the clip member with the first and second plier jaws of the tool.

5 Claims, 3 Drawing Sheets

FIG. 4
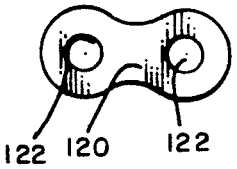
FIG. 5
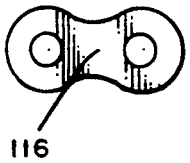
FIG. 6
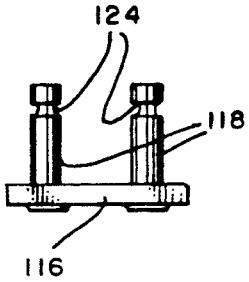
FIG. 7
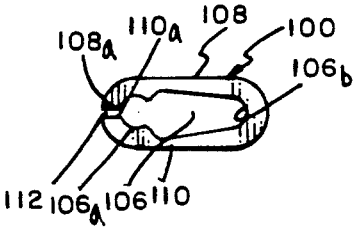
FIG. 8
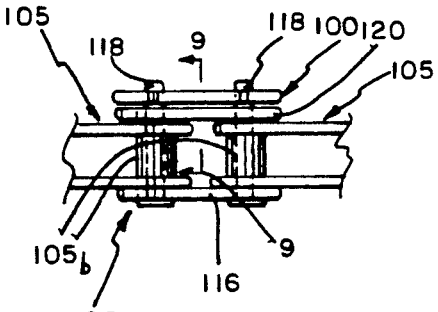
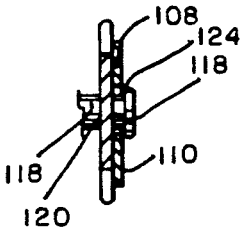
FIG. 9
FIG. 11
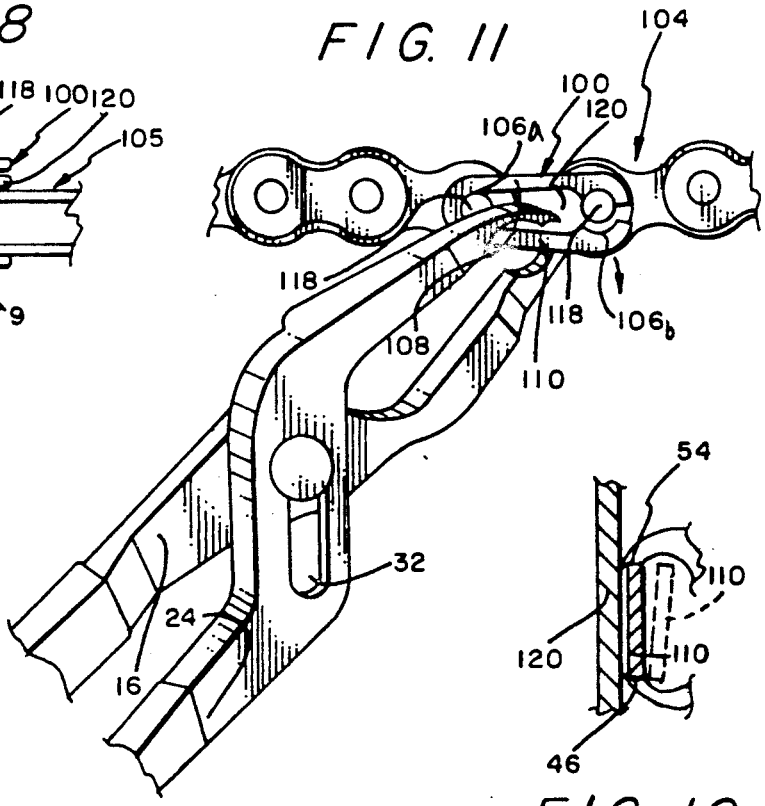
FIG. 10

TOOL AND METHOD FOR REMOVING A CLIP MEMBER FROM A MASTER LINK IN A CHAIN MEMBER

FIELD OF THE INVENTION

This invention is related to a method for removing a clip member from a master link in a chain member. More specifically, the present invention provides for a tool and a method employing the tool to remove a clip member from a master link in a chain member.

DESCRIPTION OF THE PRIOR ART

A patentability investigation was conducted and the following U.S. Patents by Nos. were discovered in the investigation:

| | |
|---|---|
| 1,785.946 - titled: | CHAIN PLIERS to Fox. |
| 3,736,644 - titled: | PLIERS to Simon. |
| 4,157,594 - titled: | ROLLER CHAIN PLIER to Raabe. |
| 4,289,015 - titled: | CHAIN LINK TOOL to Doak. |
| 4,429,525 - titled: | REPAIRING A ROLLER CHAIN TO Doak. |
| 4,833,875 - titled: | ROLLER CHAIN ASSEMBLING DEVICE to Buermann, Jr. et al. |

None of the foregoing prior art U.S. Patents teach the tool and/or method of the present invention.

SUMMARY OF THE INVENTION

The present invention accomplishes its desired objects by broadly providing a tool for removing a clip member from a master link in a chain member. The tool comprises a first member; and a second member pivotally secured to the first member. The first member includes a first handle with a first inner end, a first shank portion formed on the first inner end, and a first plier jaw formed on and carried by the first shank portion. The second member includes a second handle with a second inner end, a second shank portion formed on the second inner end and a second plier jaw formed on and carried by the second shank portion. The first plier jaw comprises a structure defining a first first arcuate recess and a first second arcuate recess, and the second plier jaw comprises a structure defining a second first arcuate recess and a second second arcuate recess.

The present invention further accomplishes its desired objects by broadly providing a method for removing a clip member from a master link in a chain member comprising the steps of:

(a) providing a tool which comprises a first member pivotally secured to a second member with said first member including a first plier jaw having a structure defining a first front ridge, a first arcuate recess and a first second arcuate recess and with said second member including a second plier jaw having a structure defining a second front ridge, a second arcuate recess and a second second arcuate recess;

(b) providing a chain member comprising a master link with a clip member slidably engaged thereto, said clip member having a pair of clip elastic sides spaced from each other;

(c) disposing the first front ridge and the second front ridge on one of the clip elastic sides;

(d) moving the first member toward the second member to cause said one of the clip elastic sides to snap away from the master link.

It is therefore an object of the present invention to provide a tool.

It is another object of the present invention to provide a method for removing a clip member from a master link in a chain member.

These, together with the various ancillary objects and features which will become apparent to those skilled in the art as the following description proceeds, are attained by this novel tool and method, a preferred embodiment being shown with reference to the accompanying drawings, by way of example only, wherein:

BRIEF DESCRIPTION OF THE DRAWINGS

FIG. 4 is a front elevational view of a rear or back link plate;

FIG. 5 is a front elevational view of a front link plate;

FIG. 6 is a top plan view of the front link plate with a pair of cylinders secured thereto;

FIG. 7 is a side elevational view of a clip;

FIG. 8 is a top plan view of the master link and clip holding together opposed ends of a claim;

FIG. 9 is a vertical sectional view taken in direction of the arrows and along the plane of line 9—9 in FIG. 8;

FIG. 10 is a partial vertical sectional view of the back link plate and a side of the clip with the side being compressed by the front ridges of the tool;

FIG. 11 is a partial perspective view of the jaws of the tool engaged to one of the sides of the clip;

DETAILED DESCRIPTION OF THE INVENTION

Figure 1:
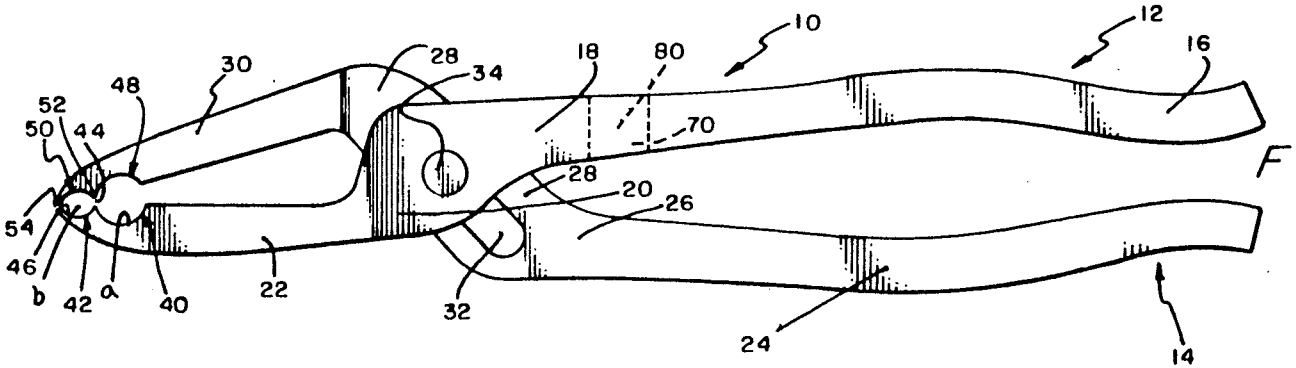
FIG. 1 is a side elevational view of the tool of the present invention.

Referring in detail now to the drawings, wherein similar parts of the invention are identified by like reference numerals, there is seen the tool or pliers, generally illustrated as 10, of the present invention. The improved tool 10 of the present invention is fashioned or constructed along the usual plier type and includes a pair of members, generally illustrated as 12 and 14 respectively. Member 12 includes a handle 16 with an inner end 18, a shank portion 20 formed on the inner end 18, and a plier jaw 22 formed on and carried by the shank portion 20 member 14 includes a handle 24 with an inner end 26, a shank portion 28 formed on the inner end, and a plier jaw 30 formed on and carried by the shank portion 28. The shank portion 28 has a structure defining a longitudinal opening 32. A bolt 34 is secured to shank portion 20 and slidably passes through longitudinal opening 32. Bolt 34 terminates in a flanged head 36 having a breadth or diameter larger than the width of the longitudinal opening 32 in order to pivotally hold members 12 and 14 together. It is obvious that by shifting and moving the bolt 34 within the longitudinal opening 32, the distance between the jaws 22 and 30 can be varied.

Figure 2:
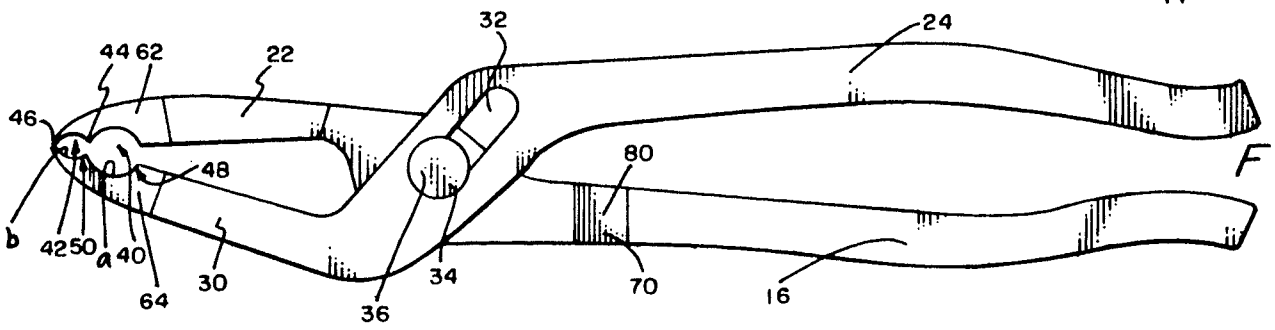
FIG. 2 is another side elevational view of the tool.

Jaw 22 has a pair of recesses generally illustrated as 40 and 42. As best shown in FIGS. 1 and 2, recesses 40 and 42 are each generally arcuate or semi-circular in vertical cross section or in a side view. Recess 40 is disposed behind and contiguous to recess 42 with a ridge 44 separating recess 40 from recess 42. Ridge 44 has width ranging from about 1/64 of an inch to about ⅛ of an inch. Jaw 22 terminates in a front ridge 46 which has a width ranging from about 1/32 of an inch to about ¼ of an inch. Recess 40 has a depth a and recess 42 has a depth b which is less than depth a. The value a preferably ranges from ⅛ inch to about ¾ inch, more preferably from about ⅜ inch to about ½ inch. The value b preferably ranges from about 5/64 inch to about ⅝ inch, more preferably from about 5/32 inch to about 5/16 inch.

Figure 3:
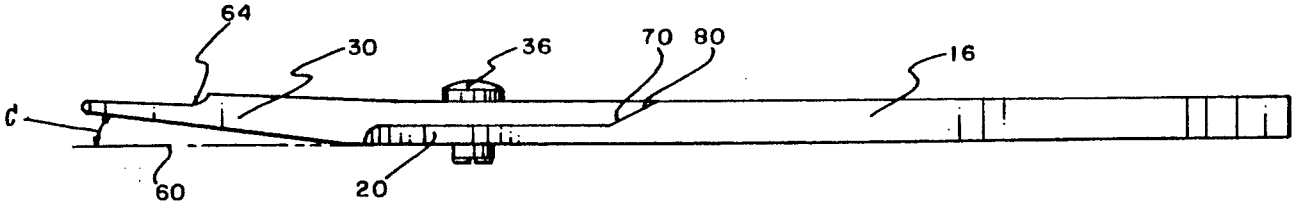
FIG. 3 is a top plan view of the tool in FIG. 1.
Figure 12:
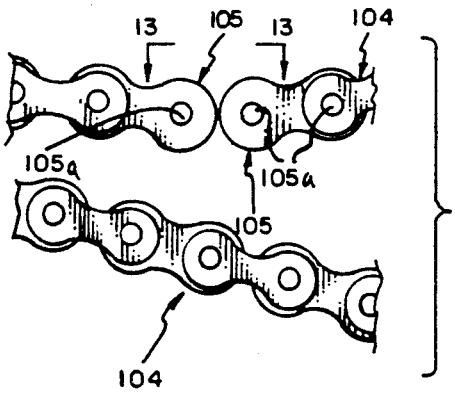
FIG. 12 is a partial side elevational view of an unlinked chain member.
Figure 13:
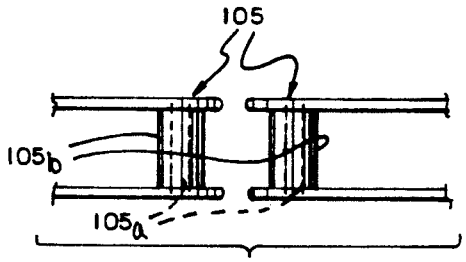
FIG. 13 is a horizontal view taken in direction of the arrows and along the plane of line 13—13 in FIG. 12.

Jaw 30 also has a pair of recesses which are generally illustrated as 48 and 50. As best shown in FIGS. 1 and 2, recesses 48 and 50 are each generally arcuate or semi-circular in vertical cross section or in a side view. Recess 48 is disposed behind and contiguous to recess 50 with a ridge 52 separating recess 48 from recess 50. Ridge 52 has a width ranging from about 1/64 of an inch to about ⅛ of an inch. Jaw 30 terminates in a front ridge 54 which has a width ranging from about 1/32 of an inch to about ¼ of an inch. Recess 48 has a depth a and recess 50 has a depth b which is less than depth a. As evident by now, recesses 40 and 42 are mirror images of recesses 48 and 50. Similarly, ridges 44 and 46 are mirror images of ridges 52 and 54. As best shown in FIG. 3 both jaws 22 and 30 are angularly disposed with respect to a plane 60 extending along and over the face of shank portion 20. The angular disposition is at an angle c (see FIG. 3) which preferably ranges from about 1 degree to about 20 degrees, more preferably about 10 degrees. Jaws 22 and 30 have planar surfaces 62 and 64 respectively, both of which define planar jaw recesses on terminal ends thereof. Handle 16 is askewed at 70 with or by a sloping surface 80 in order to align vertically or superimposedly handle 16 with handle 24.

The improved tool 10 of the present invention is utilized to remove a clip, generally illustrated as 100, from a master link, generally illustrated as 102, of a chain, generally illustrated as 104. Chain 104 has opposed ends 105 and 105, each with a cylindrical aperture or bore 105*a*. As best shown in FIG. 7, the clip 100 is a conventional clip comprising a longitudinal opening 106 having opposed structural extremities 106*a* and 106*b* and opposed by a pair of sides 108 and 110 which terminate at structural sections respectively designated as 108*a* and 110*b*. Structural sections 108*a* and 110*b* are spaced to define a clip opening 112. Sides 108 and 110 are capable of being elastically sprung or bent (or the like) away (see FIG. 11) from each other in order to remove the master link 102 from the chain 104 (typically an endless chain). The master link 102 includes a back link plate 116, a pair of cylindrical cylinders 118—118 secured to the back link plate 116, and a removable front link plate 120 having a pair of apertures 122 wherethrough the cylinders 118—118 removably passes. Each cylinder 118 has a recess 124 for receiving the clip 100, more specifically for receiving opposed structural extremities 106*a* and 106*b* of the clip 100 to hold the front link plate 120 on the pair of cylinders 118 and 118 after the cylinders 118 and 118 have passed through cylindrical bores 105*a* and 105*a* to link together the opposed ends 105—105 of chain 104 to make the latter endless.

Figure 14:
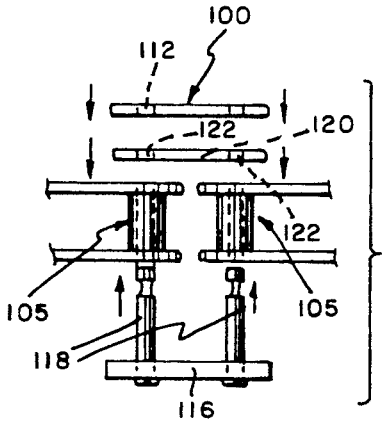
FIG. 14 is a disassembled top plan view of opposed unlinked ends of the chain member and the clip and master link.
Figure 15:
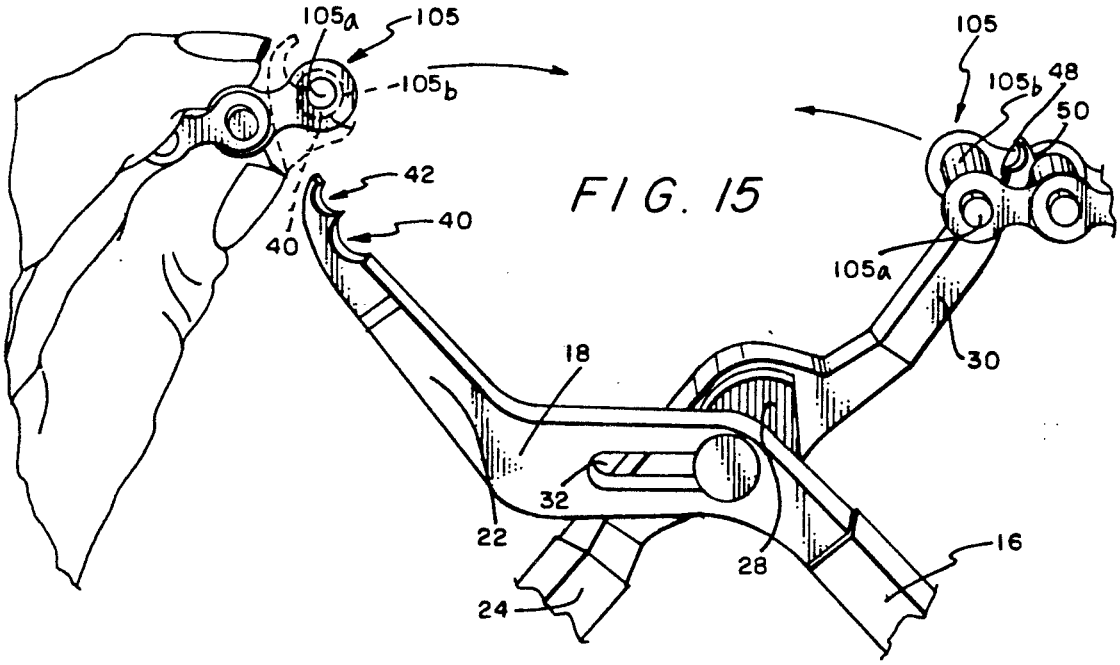
FIG. 15 is a partial perspective view of disconnected opposed ends positioned to be brought together with the tool.

To remove the clip 100, the front ridges 46 and 54 of jaws 22 and 30 are disposed on the upper and lower edges of the side 108 or the side 110. For illustration purposes and as shown in FIG. 10, the front ridges 46 and 54 of jaws 22 and 30 are positioned on the upper and lower edges of side 110. After the ridges 46 and 54 have been disposed as such, the handles 16 and 24 are squeezed or compressed together, causing the ridges 46 and 54 to wedge and/or lodge behind the side 110 or between the back of side 110 and the front link plate 122. With continuing pressure on handles 16 and 24, the wedging and/or lodging action forces the elastic side 110 off and away from the front link plate 122 and causes the side 110 to lodge in recesses 42 and 50 (see FIGS. 10 and 11). Stated alternatively, continuing compression pressure on handles 16 and 24 causes the wedging and/or lodging action and dislodges structural extremity 106*b* from recess 124 of one of the cylinders 118. The clip 100 may now be readily removed, to subsequently remove front link plate 122 off of cylinders 118 and 118 in order to slidably remove back link plate 116 to unlink and uncouple the chain 104. To reconnect the opposed ends 105—105, cylindrical barrels 105*a* and 106*a* extend, through which bores 105*a* and 105*a* are lodged in recesses 40 and 48 while the jaws 22 and 30 are in an expanded position (see FIG. 15). The handles 16 and 24 are compressed together to bring the opposed ends 105—105 in proximity to each other such that the cylinders 118—118 (see FIG. 14) may be slid through bores 105*a* and 105*a* for subsequently slidably receiving link plate 120 and the clip 100 to make chain 104 endless.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for removing a clip member from a master link in a chain member comprising the steps of:

(a) providing a tool which comprises a first member pivotally secured to a second member with said first member including a first plier jaw having a structure defining a first first arcuate recess and a first second arcuate recess and with said second member including a second plier jaw having a structure defining a second first arcuate recess and a second second arcuate recess; said first plier jaw has a structure additionally defining a first front ridge and said second plier jaw has a structure additionally defining a second front ridge;

(b) providing a chain member comprising a master link with a clip member; and said clip member has a pair of clip elastic sides spaced from each other to define a longitudinal opening and a clip opening;

(c) disposing the first front ridge and the second front ridge on one of the clip elastic sides;

(d) lodging said one of the clip elastic sides in said first first arcuate recess and in said first second arcuate recess by moving the first member towards the second member to cause said one of the clip elastic sides to snap away from the master link; and (e) removing said clip member from said master link.

2. The method of claim 1 wherein said providing step (a) further comprises providing said first front ridge and said second front ridge each with a width ranging from about 1/32 inch to about ¼ inch.

3. The method of claim 2 where said providing step (a) further comprises providing a first ridge between the first first arcuate recess and the second first arcuate recess, said first ridge has a width ranging from about 1/64 inch to about ⅛ inch.

4. The method of claim 3 where said providing step (a) further comprises providing a second ridge between the second first arcuate recess and the second second arcuate recess, said second ridge has a width ranging from about 1/64 inch to about ⅛ inch.

5. A tool for removing a clip member from a master link in a chain member comprising a first member; a second member pivotally secured to the first member; said first member including a first handle with a first inner end, a first shank portion formed on the first inner end, and a first plier jaw formed on and carried by the first shank portion; said second member including a second handle with a second inner end, a second shank portion formed on the second inner end, and a second plier jaw formed on and carried by the second shank portion; said first plier jaw comprises a structure defining a first first arcuate recess and first second arcuate recess, and said second plier jaw comprises a structure defining a second first arcuate recess and a second second arcuate recess; wherein said first first arcuate recess has a first first depth and said first second arcuate recess has a first second depth which is less than said first first depth; said second first arcuate recess has a second first depth and said second second arcuate recess has a second second depth which is less than said second first depth; wherein said first first arcuate recess and said second first arcuate recess are separated by a first ridge having a width ranging from about 1/64 inch to about ⅛ inch; said first plier jaw terminates in a first front ridge having a width ranging from about 1/32 inch to about ¼ inch; said first plier jaw is angularly disposed with respect to a plane extending along and over the first shank portion; said first plier jaw includes a first planar jaw recess; said first handle includes a structure defining a sloping surface; said second first arcuate recess and said second second arcuate recess are separated by a second ridge having a width ranging from about 1/64 inch to about ⅛ inch; said second plier jaw terminates in a second front ridge having a width ranging from about 1/32 inch to about ¼ inch; said second plier jaw is angularly disposed with respect to a plane extending along and over the first shank portion; said second plier jaw includes a second planar jaw recess.

* * * * *